US008212495B2

(12) United States Patent
Liess et al.

(10) Patent No.: US 8,212,495 B2
(45) Date of Patent: Jul. 3, 2012

(54) METHOD FOR CONTROLLING A HALF-BRIDGE CIRCUIT AND CORRESPONDING HALF-BRIDGE CIRCUIT

(75) Inventors: Uwe Liess, Treviso (IT); Bernd Rudolph, Forstern (DE)

(73) Assignee: OSRAM AG, München (DE)

( * ) Notice: Subject to any disclaimer, the term of this patent is extended or adjusted under 35 U.S.C. 154(b) by 419 days.

(21) Appl. No.: 12/524,087

(22) PCT Filed: Jan. 22, 2007

(86) PCT No.: PCT/EP2007/050576

§ 371 (c)(1),
(2), (4) Date: Jul. 22, 2009

(87) PCT Pub. No.: WO2008/089839

PCT Pub. Date: Jul. 31, 2008

(65) Prior Publication Data

US 2010/0102755 A1 Apr. 29, 2010

(51) Int. Cl.
*G05F 1/00* (2006.01)

(52) U.S. Cl. ..... 315/291; 315/297; 315/307

(58) Field of Classification Search ..... 315/291, 315/294, 307, 209 R, 209 T, 209 CD, 209 M, 315/224, 225, 276, 283, 308, 360
See application file for complete search history.

(56) References Cited

U.S. PATENT DOCUMENTS

| | | | | |
|---|---|---|---|---|
| 5,382,882 | A * | 1/1995 | Nerone | 315/307 |
| 5,828,188 | A * | 10/1998 | Lecheler | 315/309 |
| 6,072,710 | A * | 6/2000 | Chang | 363/132 |
| 6,346,779 | B1 * | 2/2002 | Aiello | 315/291 |
| 6,420,833 | B2 * | 7/2002 | Simpelaar | 315/112 |
| 6,710,552 | B2 * | 3/2004 | Schmitt | 315/224 |
| 7,242,154 | B2 * | 7/2007 | Rudolph | 315/291 |
| 7,436,127 | B2 * | 10/2008 | Ribarich et al. | 315/291 |
| 7,443,106 | B2 * | 10/2008 | Faccin et al. | 315/224 |

FOREIGN PATENT DOCUMENTS

DE 10 2005 007 34.8 8/2006

* cited by examiner

*Primary Examiner* — Vibol Tan
(74) *Attorney, Agent, or Firm* — Cozen O'Connor

(57) ABSTRACT

A circuit arrangement for operation of lamps, including a half-bridge arrangement which has an upper and a lower electronic switch (Q1, Q2), which are connected in series, each having a control connection and forming a neutral point (N1) at their connection point. The circuit arrangement further includes: a load circuit, in which a load circuit current (IL1) flows, is connected to the neutral point (N1); a feedback device; a stop device; a timer coupled to the input of the stop device; and a trigger device. A sequence controller is configured to preset an on-time ($t_{on}$) during the preheating time of the electrodes of the lamps, by means of the timer, and after the preheating time of the electrodes of the lamps, this on-time is continuously increased until it corresponds at least to one quarter of the period duration of the resonant frequency of the reactance network.

5 Claims, 4 Drawing Sheets

METHOD FOR CONTROLLING A HALF-BRIDGE CIRCUIT AND CORRESPONDING HALF-BRIDGE CIRCUIT

RELATED APPLICATIONS

This is a U.S. national stage of application No. PCT/EP2007/050576, filed on Jan. 22, 2007.

FIELD OF THE INVENTION

The present invention relates to a circuit arrangement for operation of lamps. The invention relates mainly to the operation of low-pressure gas discharge lamps. Except for aspects which relate to the preheating, the invention can also be used for equipment for LEDs.

BACKGROUND OF THE INVENTION

A circuit arrangement and a method for operation of lamps are known from the document DE 10 2005 007 346 which forms this genus. The circuit arrangement contains a stop device which can prevent the electronic switches in the half-bridge inverter from being switched on, and enables them only during an on-time. The on-time is dependent on a lamp parameter, by which means a control loop can be closed. This circuit has the disadvantage that the start burst for the lamp depends on the tolerances of the load circuit components. Furthermore, problems occur when a lamp inductor which magnetically saturates is used, because the effective resonant frequency is then also shifted.

SUMMARY OF THE INVENTION

One object of the present invention is to provide a method for controlling a half-bridge circuit, in which a start burst for the discharge lamp is relatively independent of the tolerances of the load circuit components. It should also be possible to generate the start burst using a lamp inductor which saturates severely relatively magnetically. A further object is to provide a corresponding half-bridge circuit.

These and other objects are attained in accordance with one aspect of the present invention directed to a circuit arrangement for operation of lamps comprising:

- a half-bridge arrangement which has an upper and a lower electronic switch, which are connected in series, each have a control connection and form a neutral point at their connection point,
- a load circuit in which a load circuit current flows is connected to the neutral point,
- the load circuit contains a reactance network having a resonant frequency, to which a lamp can be connected,
- the load circuit is designed such that, during normal operation for a connected lamp after the opening of one of the electronic switches, the voltage on the respective other one of the electronic switches tends to zero after a transient time,
- the circuit arrangement comprises a feedback device which couples a feedback variable from the load circuit to the control connections of the electronic switches, such that the electronic switches are switched on alternately,
- the switching arrangement comprises a stop device, which is coupled to the control connections of the electronic switches and has an input to which a stop signal can be applied, with the stop device preventing the electronic switches from being switched on as long as the stop signal is in an off state,

- the circuit arrangement comprises a timer, which is coupled to the input of the stop device and produces the stop signal, which can assume an on state and an off state,
- the circuit arrangement comprises a trigger device which in each case emits a trigger signal to the timer after the transient time has elapsed, but at the latest when the load circuit current is tending to zero,
- the timer switches the stop signal to the on state for the duration of an on-time, wherein
- a sequence controller first of all presets an on-time during the preheating time of the electrodes of the lamps, by means of the timer, which time is shorter than one quarter of the period duration of the resonant frequency of the reactance network and, after the preheating time of the electrodes of the lamps, this on-time is continuously increased until it corresponds at least to one quarter of the period duration of the resonant frequency of the reactance network. In this case, the on-time means the time during which the switches are switched on.

This advantageously allows stable production of quasi-resonant start bursts with little dependency on tolerances and without special timing for a lamp inductor which is magnetically saturated. Thermal optimization of the overall circuit can also be achieved.

According to one particular embodiment, an active on-time of the switches of the half-bridge circuit is predetermined to be fixed at the operating frequency during an operating phase. There is therefore no need for any regulation of the lamp current or the lamp power during operation.

The preheating frequency is preferably sufficiently high that the active on-time of the switches in the half-bridge circuit in the preheating phase is less than one quarter of the resonant period, while the operating frequency is sufficiently low that the active on-time is greater than one quarter of the resonant period minus a storage time of the half-bridge switches. It is therefore possible to preset a minimum frequency range or time period during which effective preheating and reliable starting are possible.

The defined period during which the frequency is continuously reduced should be between 1 ms and 100 ms. This time is sufficient to ensure reliable starting.

According to a further preferred embodiment, symmetrical starting no-load current limiting is used. This allows the start frequency to be automatically matched to load circuit tolerances and a saturating lamp inductor. In particular, it is advantageous to limit the load circuit current to a temperature-dependent limit value. This makes it possible to also take account of the temperature dependency of the saturation induction of the lamp inductor.

Furthermore, it is advantageous for the half-bridge circuit to have bipolar half-bridge switches with base series capacitors in the control loops. This makes it possible to further reduce the storage time of the bipolar transistors.

DETAILED DESCRIPTION OF THE DRAWINGS

The exemplary embodiment described in more detail in the following text represents one preferred embodiment of the present invention.

As mentioned initially, one object is to improve the half-bridge circuit such that a defined start burst is always possible, independently of the tolerances of the load circuit components. In this case, it is also always the aim to achieve losses which are as low as possible in order that no cooling measures, or only minor cooling measures, are required.

Figure 1:
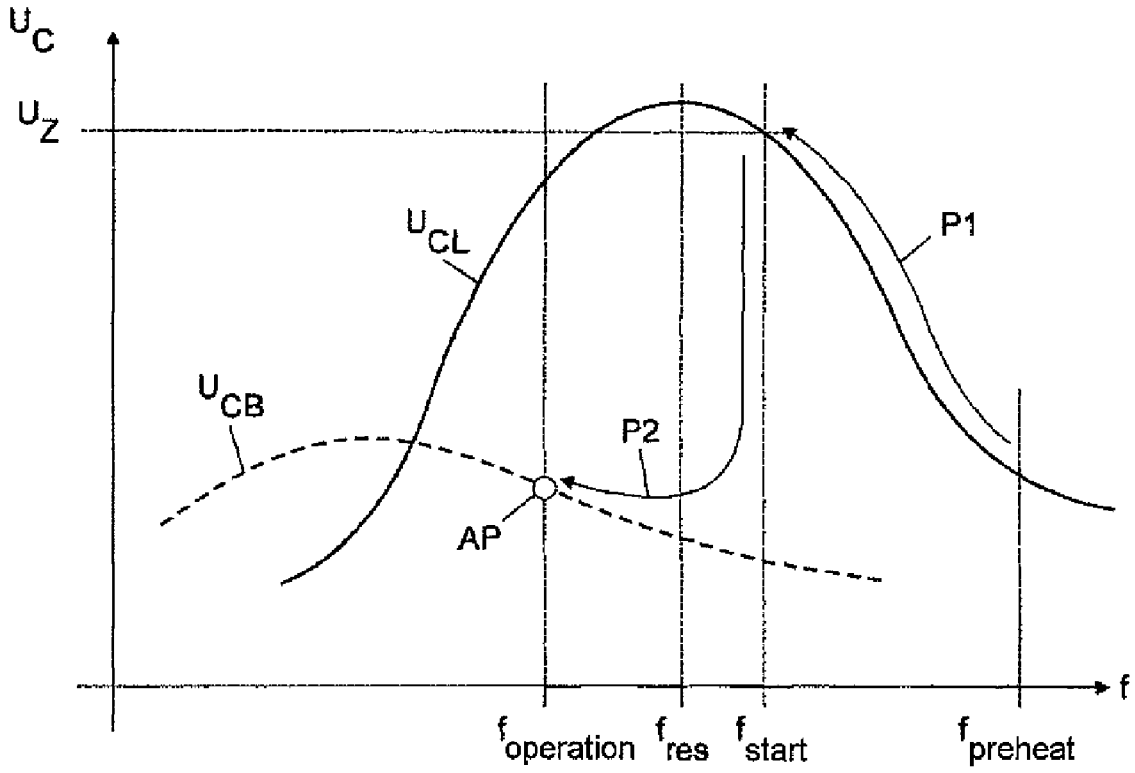
FIG. 1 shows a profile of the voltage on the resonant circuit capacitor as a function of the frequency.

FIG. 1 shows the voltage on the load circuit capacitor, which is normally connected in parallel with the lamp to be operated. On no load, that is to say without the lamp or when the lamp has not been started, the no-load profile $U_{CL}$ is a function of the frequency. The maximum of this profile is located at the resonant frequency $f_{res}$. This is where the highest voltage can be observed on the load circuit capacitor. The lamp starts at a start voltage $U_z$, which is somewhat below the voltage maximum. This start voltage $U_z$ is reached at a start frequency $f_{start}$.

In the preheating phase, which is typically between 0.4 s and 2 s, the lamp is heated at a preheating frequency $f_{preheat}$ which is considerably higher than the start frequency $f_{start}$. At this preheating frequency $f_{preheat}$, the voltage on the lamp is considerably lower than the start voltage $U_z$.

During operation of the lamp, the voltage on the load circuit capacitor is $U_{CB}$. Its profile is shown by a dashed line in FIG. 1. The lamp is finally operated at the operating frequency $f_{operation}$. This results in an operating point AP.

After preheating, the lamp can ideally be started by reducing the frequency from the preheating frequency $f_{preheat}$ to a fixed start frequency $f_{start}$. However, tolerances of the load circuit components can result in the profile of the load circuit capacitor voltage changing, such that the start voltage $U_Z$ is not reached at the fixed predetermined frequency, or it is unnecessarily high. In this case, the lamp would not start and this would result in an excessively high component load, with an excessively high voltage.

The invention therefore provides for the load circuit frequency to be reduced continuously from the preheating frequency $f_{preheat}$ through the resonant frequency $f_{res}$ (typically 50 to 60 kHz) to the operating frequency $f_{operation}$ (typically 40 to 50 kHz). In this case, the no-load voltage (the lamp has not yet been started) rises as shown by the arrow P1. It reaches the start voltage $U_Z$ at a frequency which is not known in advance or is not defined. The voltage on the load circuit capacitor now falls to the operating voltage $U_{CB}$, and the load circuit frequency is reduced further until, finally, the operating point AP is reached at the operating frequency $f_{operation}$, as is indicated by the arrow P2 in FIG. 1. A start burst can therefore occur independently of the component tolerances, as a result of which the lamp reliably starts to operate without being subjected to excessively high voltages.

Figure 4:
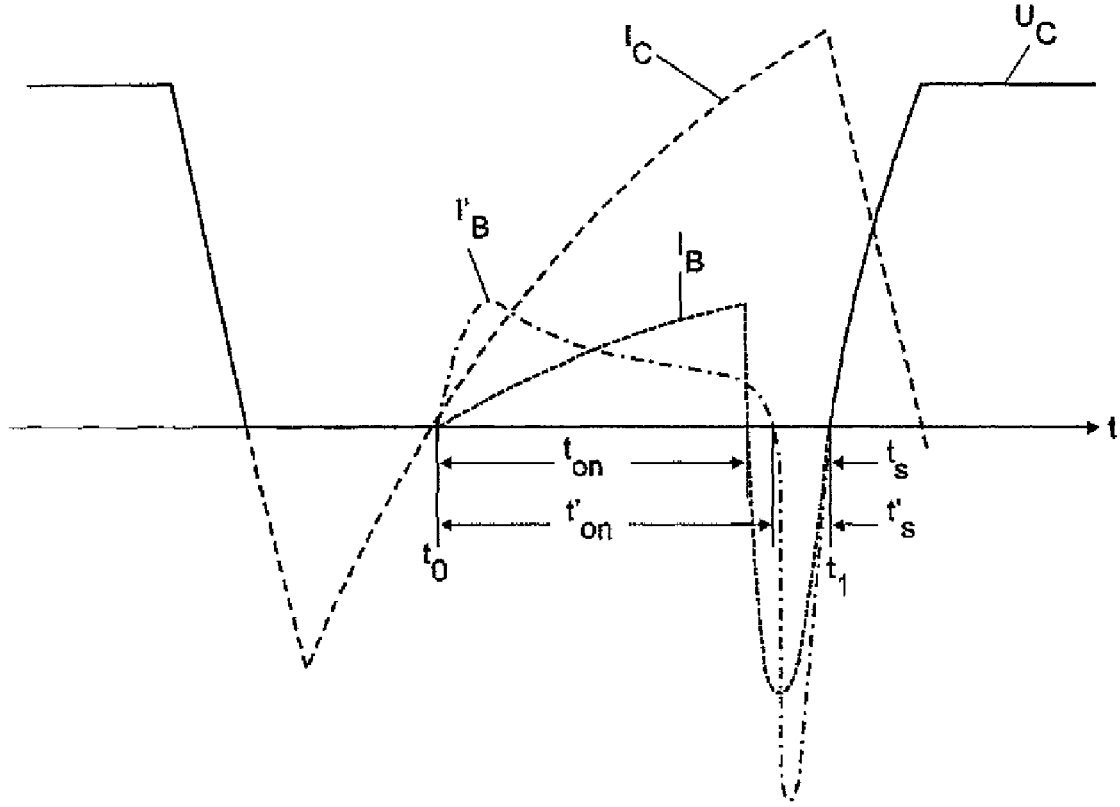
FIG. 4 shows a current/voltage diagram of the load circuit.

In order to ensure that the lamp is initially effectively preheated, then starts and is finally operated as desired, the preheating frequency $f_{preheat}$ is chosen such that the active switch-on-time $t_{on\text{-}preheat}$ is $<\frac{1}{4} T_{res}$, where $T_{res}$ represents the no-load resonant period. A sequence control unit then increases the active switch-on-time $t_{on\text{-}operation}$ to $>\frac{1}{4} T_{res}-t_s$, as a result of which the frequency falls to the operating frequency $f_{operation}$. In this case, $t_s$ corresponds to the storage time of the collector current when using bipolar transistors. An on-time $t_{on}$ is illustrated in FIG. 4 and corresponds to that time in which the base current $I_B$ of a bipolar transistor in the half-bridge circuit is greater than 0 during one half-cycle.

Figure 2:
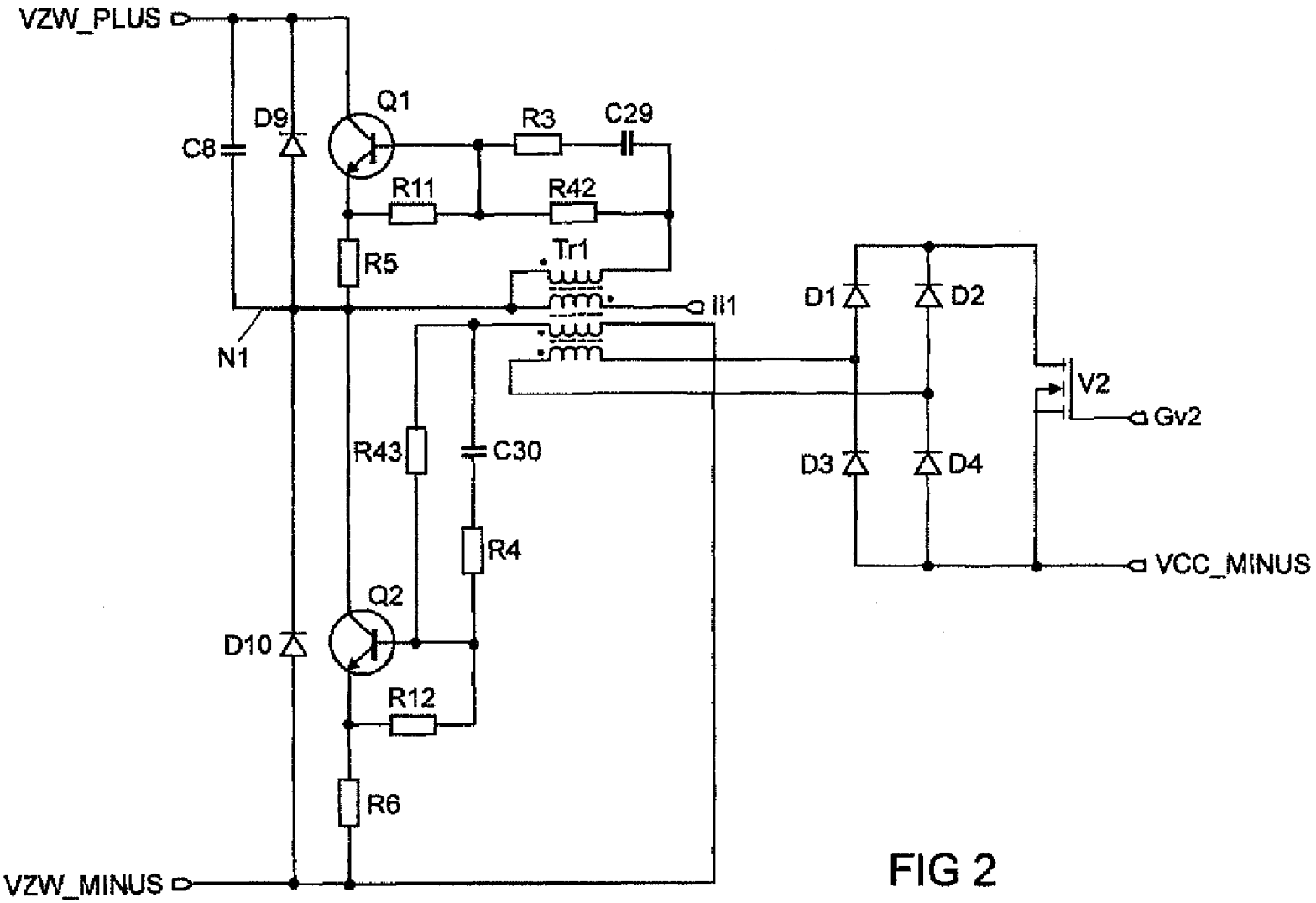
FIG. 2 shows a circuit diagram of a part of a half-bridge circuit.

A half-bridge circuit for implementation of an example of the invention is illustrated in FIG. 2. The half-bridge switches Q1 and Q2 are bipolar transistors. The two switches Q1 and Q2 are connected in series, with the intermediate circuit voltage with the poles VZW_PLUS and VZW_MINUS being applied to the series circuit. The node N1 is formed between the two switches Q1 and Q2, with a resistor R5 being connected between the emitter of the switch Q1 and the node N1. The base and the emitter of the switch Q1 are connected via a resistor R11. In addition, the base of the switch Q1 is connected to the node N1 via a parallel circuit comprising a resistor R42 with an RC series circuit R3, C29 in series with a first winding of a transformer TR1. The emitter of the switch Q2 is likewise connected to the negative pole VZW_MINUS via a resistor R6, and a resistor R12 bridges the base and the emitter of the switch Q2. Furthermore, the base of the switch Q2 is connected to the negative terminal VZW_MINUS via a parallel circuit comprising a resistor R43 with an RC series circuit R4, C30 in series with a second winding of the transformer TR1. The capacitors C29 and C30 ensure that the base current leads. Furthermore, they are used to reduce the storage time, as will be explained further below in conjunction with FIG. 4.

A diode D9 is connected in the forward-biased direction in parallel with the emitter-collector path through the switch Q1, and a diode D10 is likewise connected in parallel with the emitter-collector path through the switch Q2. These diodes D9 and D10 are used as freewheeling diodes for the switches Q1 and Q2. A capacitor C8 is connected in parallel with the diode D9, and acts as a trapezoidal capacitor.

In addition to the two windings that have already been described, the transformer TR1 has a third winding, via which a stop function is controlled. This third winding is coupled to the AC voltage connections of a full-bridge rectifier, which is formed by the diodes D1, D2, D3 and D4. The DC voltage connections of this rectifier are connected in parallel with an electronic switch V2. The third winding, the rectifier and the switch V2 form a stop device. The switch V2 is a MOSFET transistor, whose source connection is connected to the reference potential VCC_MINUS. As soon as a stop signal, which corresponds to an off state, appears at the gate of the switch V2, the switch V2 short-circuits the third winding of the transformer TR1 via the rectifier. The control inputs of the electronic switches Q1 and Q2 are therefore also short-circuited via the transformer TR1, as a result of which the two switches are switched off.

The switch V2 is controlled by a timer U1. In the example shown in FIG. 3, this timer is formed by a CMOS-IC 555. The circuit U1 produces the stop signal at PIN3. In order to achieve the correct polarity for driving the switch V2, the signal must be inverted. This is achieved by the inverter U2-D.

The supply terminals VCC_PLUS and VCC_MINUS are provided in order to supply power to the circuit U1, and are connected to PIN8 and PIN1 in the circuit.

The series circuit comprising a resistor R1 and a capacitor C1, which is connected between the two supply terminals VCC_PLUS and VCC_MINUS, leads to a time constant which governs the on-time $t_{on}$. The connecting point between the resistor R1 and the capacitor C1 is connected both to PIN6 and to PIN7 in the circuit U1, in order to preset the appropriate time constant for the timer. PIN4 in the circuit U1 forms a reset input, and must be connected to the positive operating voltage with a high impedance via R2 in order to ensure the desired functionality of the circuit U1.

PIN2 in the circuit U1 forms a trigger input and is initially connected via a resistor R25 to the positive supply terminal VCC_PLUS. A negative pulse is required at PIN2 in order to initiate the timer. This negative pulse is produced by a comparator U3-A which, for example, may be formed by the component LM293. The trigger pulse is supplied directly to PIN2 in the circuit U1. The inverting input of the comparator U3-A is connected to VCC_PLUS via a resistor R28, and to VCC_MINUS via a resistor R29.

The non-inverting input of the comparator U3-A is fed from the DC voltage output of a full-bridge rectifier GL1. The secondary winding of a current transformer or transformer TR3 is connected to the AC voltage input of this full-bridge rectifier GL1. The primary winding of the transformer TR3 is connected between the load circuit and the terminal Il1 (cf. also FIG. 2).

Furthermore, the DC voltage output of the full-bridge rectifier Gl1 is terminated with a low impedance by a series circuit comprising the resistors R30 and R31. A voltage which is proportional to the rectified load current is therefore applied to the non-inverting input of the comparator U3-A. At the load current zero crossing, the voltage at the inverting input of the comparator U3-A is briefly higher than the voltage at the non-inverting input. This results in a negative trigger pulse as the comparator signal. The components U3-A, R28, R29, R30, R31, GL and TR3 therefore form a trigger device based on current zero-crossing detection. As soon as a load current zero crossing occurs, the timer is triggered and switches the transistor V2 off for the on-time, thus allowing the switches Q1 and Q2 to be operated.

In order to reset the timer, the output signal from a further comparator U3-B is applied to PIN4 of the circuit U1. Its inverting input is connected between the resistors R30 and R31. The non-inverting input is connected between a series circuit comprising resistors R26 and R27, which is itself connected between the supply terminals VCC_PLUS and VCC_MINUS. The timer is reset, and the respective half-bridge switch is therefore actively switched off, when the rectified load current exceeds a certain value.

The duration of the preheating time (typically 0.4 to 2 s) and the duration of the transient time from the preheating frequency $f_{preheat}$ to the operating frequency $f_{operation}$ (preferably 1 ms to 100 ms in order charge carriers can build up in the lamp for starting) are set via PIN5 in the circuit U1. The switching time from the preheating phase to the operating phase is governed by an RC element comprising a series circuit of a resistor R24 with a capacitor C2. The capacitor C2 is connected between PIN5 and the negative supply terminal VCC_MINUS. In contrast, the duration of the preheating time is governed by the RC series circuit R23, C3 which is connected between the two supply terminals VCC_MINUS and VCC_PLUS. A node N2 between the two components R23 and C3 is connected to the input of the inverter U2-B, and a diode D6 is connected to the resistor R24 and therefore to PIN5 in the circuit U1. The diode D6 dynamically connects the resistor R24 in parallel with C2 only during the preheating phase, in order to ensure the desired timing.

Figure 3:
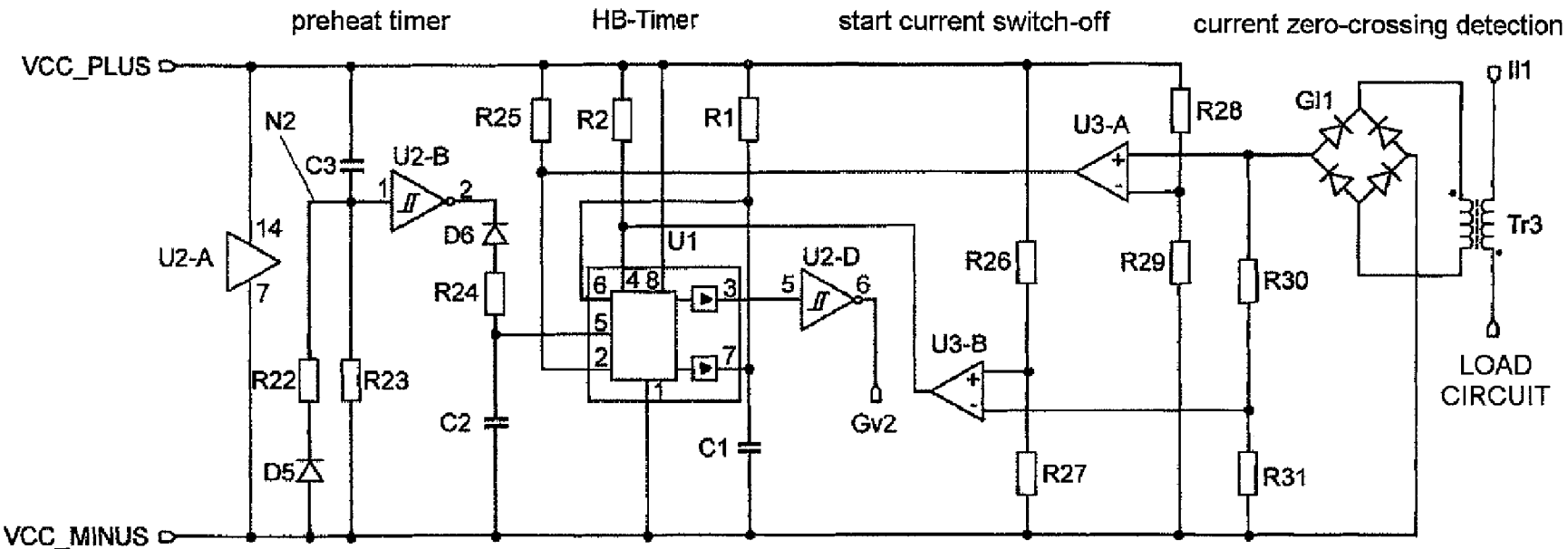
FIG. 3 shows a circuit diagram of drive components for the half-bridge circuit shown in FIG. 2.

The half-bridge circuit illustrated in FIGS. 2 and 3 results in symmetrical starting no-load current limiting, that is to say relating to both load circuit current half-cycles, in that both power switches Q1, Q2 in the half-bridge arrangement are switched off on reaching a specific, predeterminable current limit value. This value is given by:

$$f_L = R27/(R26+R27)*(V_{CC\text{-}PLUS} - V_{CC\text{-}MINUS})*w_{1TR3}/(w_{2TR3}*R31),$$

where $w_{1TR3}$ and $w_{2TR3}$ represent the number of turns on the transformer TR3.

The comparator can be formed from a current mirror in the trigger circuit of the timer. This is also known by the expression "emitter-controlled differential comparator".

As mentioned, one aim is to operate the lamp with losses that are as low as possible. This also includes achievement of switching with losses that are as low as possible. This can be done in inductive operation of the lamp. For this purpose, the voltage is reduced to zero, and the current is switched in this state. At the same time, the current should be as low as possible during switching. The respective bipolar transistor Q1, Q2 is therefore switched on at the current zero crossing, as is indicated by the base current $I_B$ in FIG. 4. This current profile of the base current $I_B$ occurs in the case of an ideal current transformer TR1, with the base current $I_B$ being in phase with the current $I_C$ in the load circuit. After the switch-on-time $t_{on}$, the base current $I_B$ is switched off by the timer and the switch V2. Excess charge carriers in the bipolar transistor result in a storage time $t_s$, as a result of which the respective bipolar transistor is not actually switched off until the time $t_1$.

In order to shorten this storage time, a base series capacitor C29 is, as mentioned, connected to the base of the bipolar transistor Q1, and a base series capacitor C30 is connected to the base of the bipolar transistor Q2. In consequence, the base current rises more rapidly after switching on, as is indicated by the dashed-dotted line $I_B'$ in FIG. 4. At the same time, the base current profile after being switched off is steeper and deeper, and this is evident in a shorter storage time $t_s'$. The shorter storage time $t_s'$ also at the same time makes it possible to increase the on-time starting from $t_0$ to $t_{on}'$. This makes it possible to further reduce the losses in the bipolar transistors Q1 and Q2.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for operation of lamps, comprising:

a half-bridge arrangement which has an upper and a lower electronic switch, which are connected in series, each have a control connection and form a neutral point at their connection point;

a load circuit, in which a load circuit current flows, connected to the neutral point;

the load circuit includes a reactance network having a resonant frequency, and adapted so that a lamp can be connected thereto;

the load circuit is configured such that, during normal operation for a connected lamp after the opening of one of the electronic switches, the voltage on the respective other one of the electronic switches tends to zero after a transient time;

a feedback device which couples a feedback variable from the load circuit to the control connections of the electronic switches, such that the electronic switches are switched on alternately;

a stop device, which is coupled to the control connections of the upper and lower electronic switches and has an input to which a stop signal can be applied, with the stop device being configured for preventing the electronic switches from being switched on as long as the stop signal is in an off state;

a timer, which is coupled to the input of the stop device and produces the stop signal, which can assume an on state and an off state, the timer switching the stop signal to the on state for the duration of an on-time;

a trigger device which in each case emits a trigger signal to the timer after the transient time has elapsed, but at the latest when the load circuit current is tending to zero;

wherein a sequence controller configured to preset an on-time during the preheating time of the electrodes of the lamps, by means of the timer, which time is shorter than one quarter of the period duration of the resonant frequency of the reactance network and, after the preheating time of the electrodes of the lamps, this on-time is continuously increased until it corresponds at least to one quarter of the period duration of the resonant frequency of the reactance network, and the on-time is increased continuously in 1 to 100 ms from the minimum value during the preheating time to the maximum value during operation of the lamps.

2. The circuit arrangement as claimed in claim 1, further comprising a threshold value device configured to compare the load circuit current with a predeterminable current limit value, and, when this current limit value is reached, to emit a reset signal to the timer and to switch the stop device to the off state.

3. A circuit arrangement for operation of lamps, comprising:

a half-bridge arrangement which has an upper and a lower electronic switch, which are connected in series, each have a control connection and form a neutral point at their connection point;

a load circuit, in which a load circuit current flows, is connected to the neutral point;

the load circuit includes a reactance network having a resonant frequency, and adapted so that a lamp can be connected thereto;

the load circuit is configured such that, during normal operation for a connected lamp after the opening of one of the electronic switches, the voltage on the respective other one of the electronic switches tends to zero after a transient time;

a feedback device which couples a feedback variable from the load circuit to the control connections of the electronic switches, such that the electronic switches are switched on alternately;

a stop device, which is coupled to the control connections of the upper and lower electronic switches and has an input to which a stop signal can be applied, with the stop device being configured for preventing the electronic switches from being switched on as long as the stop signal is in an off state;

a timer, which is coupled to the input of the stop device and produces the stop signal, which can assume an on state and an off state, the timer switching the stop signal to the on state for the duration of an on-time;

a trigger device which in each case emits a trigger signal to the timer after the transient time has elapsed, but at the latest when the load circuit current is tending to zero;

wherein a sequence controller configured to preset an on-time during the preheating time of the electrodes of the lamps, by means of the timer, which time is shorter than one quarter of the period duration of the resonant frequency of the reactance network and, after the preheating time of the electrodes of the lamps, this on-time is continuously increased until it corresponds at least to one quarter of the period duration of the resonant frequency of the reactance network, and the on-time is predetermined to be fixed at the operating frequency during the operating phase of the lamps.

4. The circuit arrangement as claimed in claim 3, wherein, in the case of bipolar half-bridge switches, the on-time in the operating phase of the lamps is greater than one quarter of the period duration of the reactance network minus a storage time $t_s$.

5. A circuit arrangement for operation of lamps, comprising:

a half-bridge arrangement which has an upper and a lower electronic switch, which are connected in series, each have a control connection and form a neutral point at their connection point;

a load circuit, in which a load circuit current flows, is connected to the neutral point;

the load circuit includes a reactance network having a resonant frequency, and adapted so that a lamp can be connected thereto;

the load circuit is configured such that, during normal operation for a connected lamp after the opening of one of the electronic switches, the voltage on the respective other one of the electronic switches tends to zero after a transient time;

a feedback device which couples a feedback variable from the load circuit to the control connections of the electronic switches, such that the electronic switches are switched on alternately;

a stop device, which is coupled to the control connections of the upper and lower electronic switches and has an input to which a stop signal can be applied, with the stop device being configured for preventing the electronic switches from being switched on as long as the stop signal is in an off state;

a timer, which is coupled to the input of the stop device and produces the stop signal, which can assume an on state and an off state, the timer switching the stop signal to the on state for the duration of an on-time;

a trigger device which in each case emits a trigger signal to the timer after the transient time has elapsed, but at the latest when the load circuit current is tending to zero;

wherein a sequence controller configured to preset an on-time during the preheating time of the electrodes of the lamps, by means of the timer, which time is shorter than one quarter of the period duration of the resonant frequency of the reactance network and, after the preheating time of the electrodes of the lamps, this on-time is continuously increased until it corresponds at least to one quarter of the period duration of the resonant frequency of the reactance network, and the bipolar half-bridge switches have base series capacitors in the control loops.

* * * * *